United States Patent [19]

Goncalves et al.

[11] 3,980,416

[45] Sept. 14, 1976

[54] OIL BURNER FOR OIL-WELLS

[75] Inventors: Carlos Alberto de Castro Gonçalves; Romeu Almeida Neves; José Bernardo Drucker, all of Rio de Janeiro, Brazil

[73] Assignee: Petroleo Brasileiro S.A.-Petrobras, Brazil

[22] Filed: Mar. 27, 1975

[21] Appl. No.: 562,739

[30] Foreign Application Priority Data

Mar. 27, 1974 Brazil ..... 2404

[52] U.S. Cl. ..... 431/202; 431/190; 431/353

[51] Int. Cl.[2] ..... F23L 7/00

[58] Field of Search ..... 431/2, 190, 353, 202, 431/4

[56] References Cited

UNITED STATES PATENTS

| | | | |
|---|---|---|---|
| 3,565,562 | 2/1971 | Drivet | 431/184 |
| 3,797,992 | 3/1974 | Straitz | 431/190 X |
| 3,807,932 | 4/1974 | Dewald | 431/2 |
| 3,894,831 | 7/1975 | Glotin et al. | 431/190 X |

*Primary Examiner*—Edward G. Favors
*Attorney, Agent, or Firm*—Sughrue, Rothwell, Mion, Zinn and Macpeak

[57] ABSTRACT

An oil burner for oil wells in which the oil to be eliminated is admitted to a specially designed sprayer in which its mechanical atomization is brought about by the construction of said sprayer and its pneumatic atomization is effected by means of inputting gas or air under pressure, the atomized product being ignited by means of spark ignitors and the flame produced being protected by a cylindrical casing. Said casing is provided with a front spray ring which injects water into the flame so as to eliminate the formation of black smoke, and a back spray ring for forming a water curtain which protects the platform against heat radiation from the flame.

Said burner is mounted on a tubular support permitting its rotation so as to accompany the wind direction.

The material combustion capacity of said burner can reach 30 cubic meters an hour, and for higher flow rates, various identical units can be coupled in parallel.

12 Claims, 6 Drawing Figures

OIL BURNER FOR OIL-WELLS

The present invention refers to an oil burner suitable for eliminating formation test and production products from oil wells localized on the marine shelf or from pioneer wells localized on the mainland. The present invention is also useful as a means for burning oil residues and sub-products in refineries and storage installations.

The burner of the present invention is principally characterized by its simple handling during operation and maintenance, its simple and efficient rotating system and principally the fact that it permits burning without the undesirable formation of black smoke at high flow rates, even when used for viscous fluids.

It is known that at the end of the drilling operations of a well, various tests are necessary to permit the evaluation of the production potential of the well. These tests would make it necessary to permit the flow of the products from the well to the outside, it being essential to eliminate those parts which do not have any commercial value. In such a case, it is found to be advisable to eliminate the mentioned test products by incineration due to the difficulties found in the other alternatives.

Thus, transport of the products to the mainland, in the case of a marine well, would be extremely onerous due to the large amount of time during which the necessary barges would be immobilized since there is always the lack of certainty when the tests will begin. On the other hand, the handling of the products during loading and unloading of the barges is fairly dangerous not only because of the agitated state of the sea but also because the oil produced has a fraction having a low firing point which gives rise to a fire risk.

As to the possibility of discharging the products into the sea, this cannot even be considered since it is universally recognized that everything possible should be done to avoid the pollution of the marine ambient to preserve the vegetable and animal life. For the same reason, it is necessary to avoid the accidental spillage of the products into the sea during the elimination of the said products.

When the tests are carried out on land, the problem is also grave since the spillage of the products onto the ground is undesirable, not only because they will damage the vegetable and animal life but also because of the risk that they might reach water-ways and thus spread pollution. Also in this case, transport is onerous since relatively small capactiy vehicles would have to be used, for which reason it becomes necessary to construct fixed tanks which, apart from being expensive, sometimes may not be re-used.

Apart from this, pioneer wells are often situated in regions of difficult access which makes it entirely undesirable to transport the test product, for which reason it becomes essential to eliminate the product on the site.

It can thus be seen from the above explanation that elimination by incineration of the formation test and production products is the only economically and ecologically advisable solution.

There are also other cases in which there is the necessity to eliminate undesirable residues by incineration, such as the residues left in oil and derivative storage tanks in refineries and terminals. As in the case of wells, here also it is necessary to avoid pollution of the atmosphere. The burner of the present invention is also particularly advisable in these cases since the presently known eliminating means in the above mentioned installations do not result in an elimination of the residues which is as efficient as might be desired.

The first of the prior art apparatuses had the disadvantages of the formation of undesirable black smoke, apart from providing an incomplete combustion when the flow rates of the product ot be burned were high (for example, above 10 cubic meters per hour). In this case, the unburned oil was still discharged into the sea causing pollution of the water, while the smoke caused atmospheric pollution which not only prejudiced the work on the platform itself but also, when drilling was being made near the coast, extended pollution to regions on the mainland close to the well.

With a view to eliminating these disadvantages, other burners were developed, which, however with a view to promoting complete combustion, required the inclusion of additional equipment such as, for example, secondary airblowers which in spite of improving the combustion characteristics, notably increased the weight of the equipment and made its functioning dependent on auxiliary equipment subject to premature wear, resulting in expensive maintenance apart from operating and installation difficulties since stronger and thus heavier supports became necessary.

The present invention provides equipment which succeeds in burning the oil with the elimination of the formation of black smoke, its design however being compact so as not to result in excessive weight, thus making it easy to handle, requiring reasonably simple supports and being much lighter than the conventional equipment, the present design also permitting simple rotation due to the arrangement of its articulations.

Apart from this, due to the simplicity of the design, its maintenance is much simpler than the previously known models since it permits rapid dismounting and substitution of parts.

Although the obligatory use of a water curtain shield against thermal radiation at the front part of the burner has not been shown in the earlier inventions, practice has shown it to be necessary to include such an improvement either due to the necessity to protect the platform against excessive heating or due to the protection given to the back parts of the equipment itself. Thus, according to the present invention, apart from water being injected in the form of mist directly into the flame so as to balance the burning conditions, there is a ring of sprays at the back part of the flame shield cylinder (which will be described later in the specification), so that the platform and the back part of the equipment are completely protected against the damaging effect of excessive thermal radiation.

Apart from this, the water supply to the two spray rings (in the region of the flame and at the back shield curtain) comes from the same supply header so that a single water flow control can be used to increase or reduce the intensity of the jets from the two rings, this being easily understandable to those versed in the art since if the flow rate of the water next to the flame diminishes due to the reduction of the flame, it is possible to reduce the flow rate of the water in the back shield curtain since the thermal radiation intensity is diminished. This results in a considerable simplification in the control of the operation of the burner which is not present in the earlier inventions.

The possibility of controlling the atomization or spraying of the oil both by means of a pneumatic actuator and by the injection of air into the specially designed chamber to be described later, and also the considerable swirling acchieved by the introduction of a spray turbine, make the combustion more efficient and permit a quicker and more reliable adjustment of the flame conditions should there be a sudden variation in the product flow rate. It is not possible to obtain such a control in previously known models.

BRIEF DESCRIPTION OF THE DRAWINGS

FIG. 1 shows the complete system for the operation of the burner in a schematic manner. The flow coming from the well passes to the separator 64 where the gas is separated which can be burned in the flare 65. A drain 66 is provided for eliminating the debris or waste from the separator 64. The product continues to the sprayer 38 if its pressure is sufficient at the outlet of the separator. When the pressure is insufficient, it passes to a tank 67 where it is pumped by pump 68 to the input of the sprayer. When its pressure is very high, the product is by-passed to tank 67 through a valve 69 controlled by controller 70.

Figure 1:
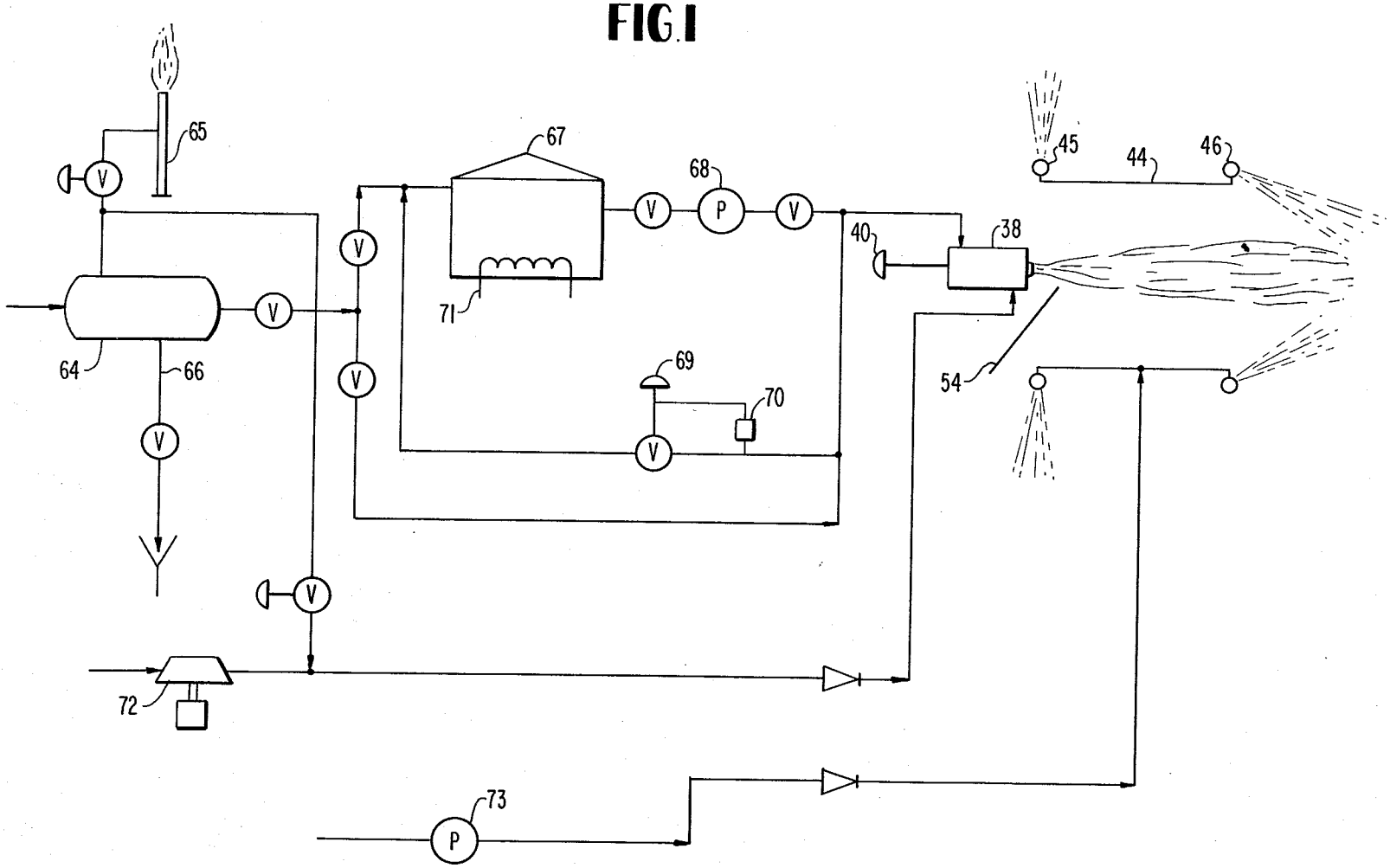
FIG. 1 shows a schematic of the complete burner system.

The sprayer 38 is controlled by the pneumatic actuator 40 in such a manner that a suitable atomization of spray of the product is achieved for burning under any supply conditions.

if the product is very viscous, there is a heating system 71 in tank 67 for making it more fluid and permitting its atomization.

This however is not essential to the present invention since the present burner is capable of burning high-viscosity fluids.

The air-compressor 72 provides compressed air for the burner in such a way as to permit pneumatic atomization in a chamber which will be described in more detail later. The volume of compressed air is regulated in accordance with the flow-rate of the product so as to maintain the optimum atomization level.

The injection of compressed air can be substituted by gas from the separator when the gas production of the well is sufficient for feeding the sprayer, in which case the use of the air compressor may be dispensed with, this representing an economy and simplified operation.

A shield or casing 44, in the present embodiment shown to be cylindrical, coaxially surrounds the sprayer so as to protect the flame head against strong winds.

Around the casing there are two rings of water sprayers 45 and 46 fed by water pump 73, their function being respectively to form a water curtain behind the flame so as to protect the platform from the thermal effects due to the combustion 45, and to inject water into the flame so as to improve combustion, 46.

The volume of water can be regulated either by control valves or by adjusting the water pump 73 in accordance with the flow rate and the characteristics of the product to be burned.

At the outlet of the sprayer 38 there is an igniter 54 whose function is to ignite the misture and re-ignite it should the flame be extinguished.

The burner comprising the sprayer-controller-casing-water rings combination is supported by a jib (not shown in the drawings) whose function is to maintain the burner away from the platform so as to lessen the effects of thermal radiation. Both the jib and the burner can rotate so as to be disposed in the direction of the prevailing wind.

Figure 2:
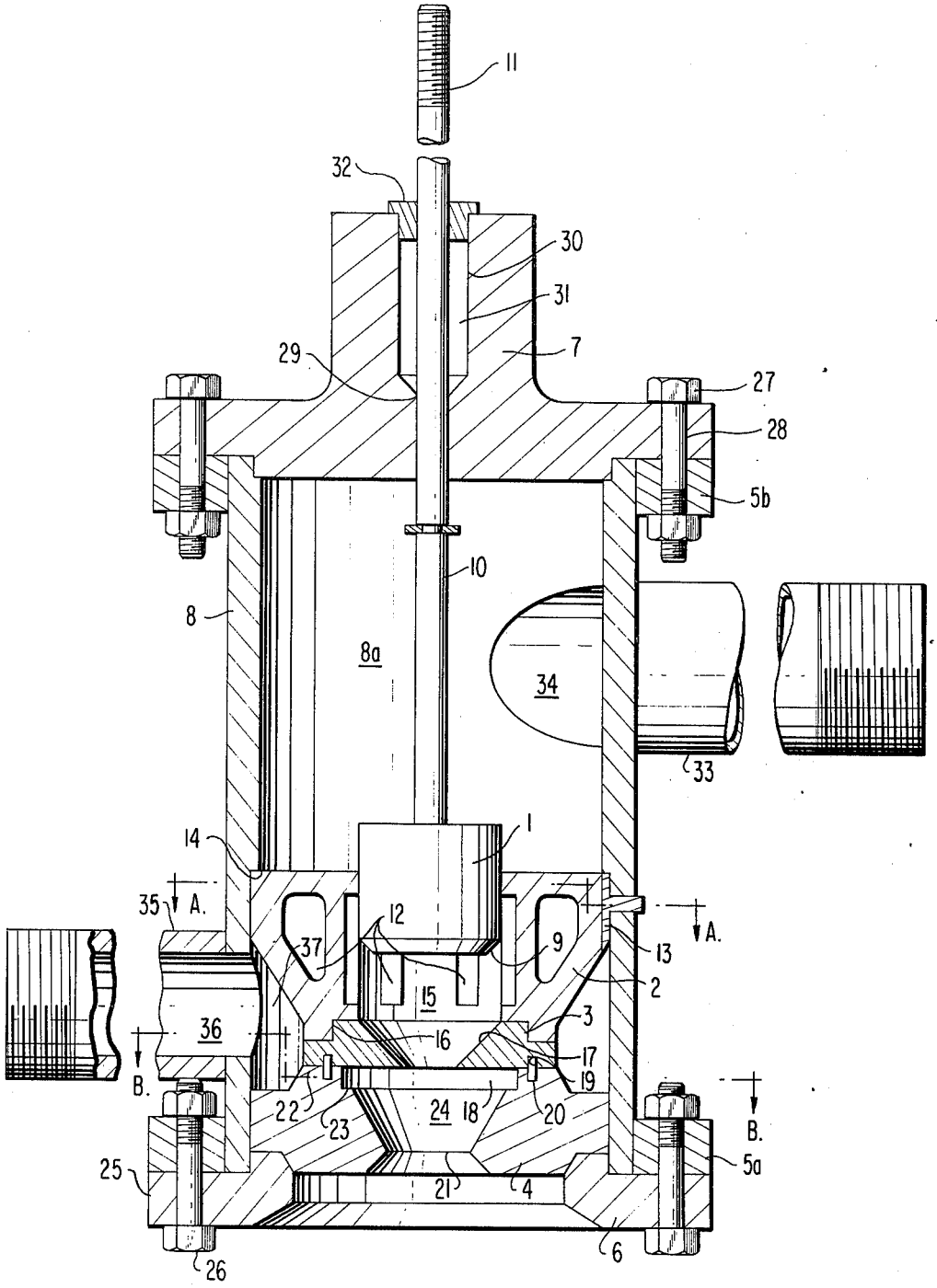
FIG. 2 is a longitudinal cross-section of the sprayer.

As is shown in FIG. 2, the sprayer comprises a combination of parts to be described, closed within a cylindrical housing 8.

These parts are: the piston 1, the turbine 2, the intermediate disc 3 and the centripetal stator 4.

Piston 1 is a solid metal cylinder provided: (a) at a front part, with a slight taper 9 for permitting its perfect fit into: cavity 17 of part 3, as will be shown later; (b) in its back part, with an elongate cylindrical rod 10 which projects out of the sprayer, the male thread 11 making it possible to connect it to the pneumatic actuator.

Figure 3:
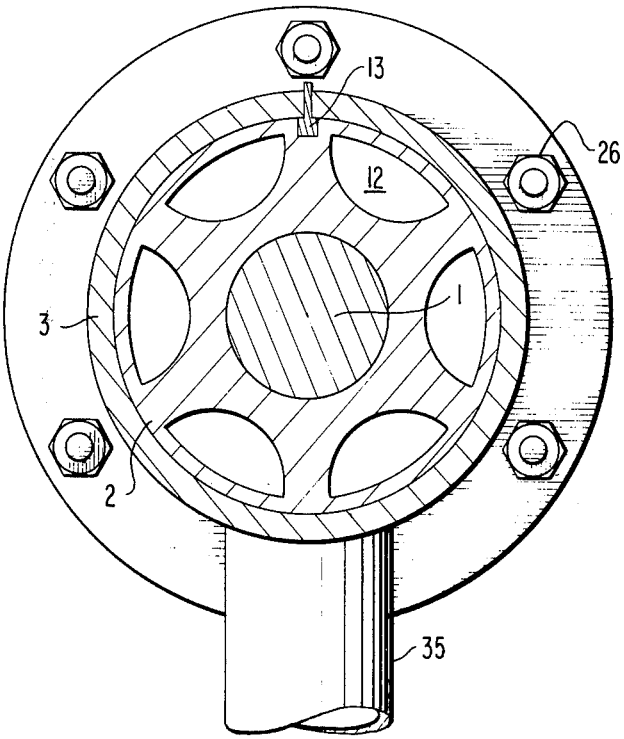
FIG. 3 is a cross-section of FIG. 2 along line A—A.

Turbine 2 — also shown in FIG. 3 — is a metal (hollow) part having a cylindrical tapered outer surface and provided internally with helicoidal channels 12, there being six of them in the present example, which converge toward the interior of the turbine. Apart from this it also has in its outer part, a slit for receiving the spline 13 which fixes it to the cylindrical housing 8. Said turbine 2 is housed within cylindrical housing 8 with a perfect fit by insertion up to the shoulder 14, its rotation being prevented by the above mentioned spline 13.

The central orifice of the turbine 2 forms a cylindrical chamber 15 to which the helicoidal channels 12 converge.

The piston 1 which regulates the outlet area of the said channels 12 is reciprocatable during the operation of the burner within the said cylindrical chamber (15).

The intermediate disc 3 is a specially designed part containing: (a) a shoulder 16 for fitting with the turbine 2; (b) a central tapered cavity 17 terminating, at its front face, at the orifice 18; (c) special orifice jets 19 of which, in the present case, there are two, for receiving pins 20 which fix them to the centripetal stator 4.

Figure 4:
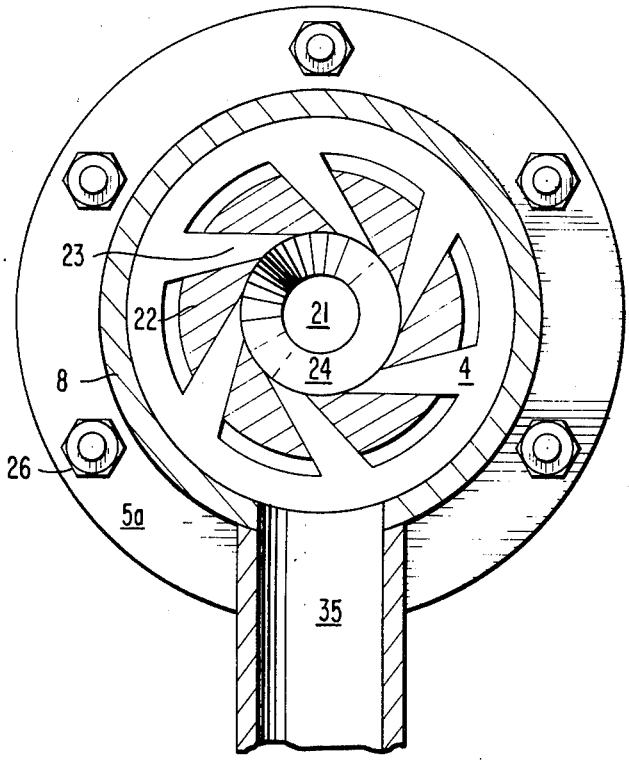
FIG. 4 is a cross-section of FIG. 2 along line B—B.

The centripetal stator 4 is also shown in FIG. 4 and basically comprises a thick disc-shaped part crossed, at its geometrical center, by a nozzle 21 which is a double cone cavity of the convergent-divergent type and provided at its back face with relief regions 22 between which are formed channels 23 converging to the interior of the centripetal stator 4. These channels (as will be described later in more detail) are for admitting air to the mixing chamber 24 formed in the space limited by the nozzle 21 and the intermediate disc 3, within the centripetal stator 4.

So as to permit the fixture of the combination of parts 2, 3 and 4 in the cylindrical housing 8, there is a front closure 6 which is a ring-shaped metal part provided with holes 25, there being six in the present example, which are for receiving screws 26 which permit its fixture to flange **5*a*.**

Said flange **5*a* is a ring fixed to the front end of the cylindrical housing 8 whose only purpose is to fix the front closure 6.**

The back part of the cylindrical chamber 8 is provided with flange **5*b* for fixing the back closure 7. This fixture is obtained by the screws 27 which pass through the holes 28 in the back closure 7.**

The above mentioned back closure 7 is a cylindrical part provided with a central channel 29 for permitting passage of rod 10. With a view to providing suitable sealing for the interior of the cylindrical housing 8, the front part of said channel 29 has an internal diameter equal to the external diameter of rod 10, its back part being however enlarged 30 for receiving a sealing gasket 31 to which the back cover 7 is fixed by means of a bushing 32.

The cylindrical housing 8 is provided with two orifices to which pipes are connected for admitting, respectively, the products to be burned and the air or gas necessary for the pneumatic atomization.

The inlet pipe 33 for the product to be burned is connected to the cylindrical housing 8 at the back part of said housing by means of the opening 34 which is made in such a manner that the longitudinal axis of said pipe 33 does not coincide with a radial line of the housing. This is important so that when the product is admitted to the chamber, the flow does not directly impinge upon the rod 10. On the contrary, the product flow on entering the chamber 8*a* in the direction determined by the positioning of the inlet pipe 33, will be given a circular movement so as to increase the swirling action, thus improving the atomization conditions, which is an important characteristic of the present invention.

The air inlet pipe 35 is connected to the housing 8 in a radial direction by means of opening 36. The said opening 36 is positioned at the front part of the housing so that the air be admitted exactly within the annular space 37 delimited by the turbine 2, the intermediate disc 3, the centripetal stator 4 and the inner wall of the housing 8.

Figure 5:
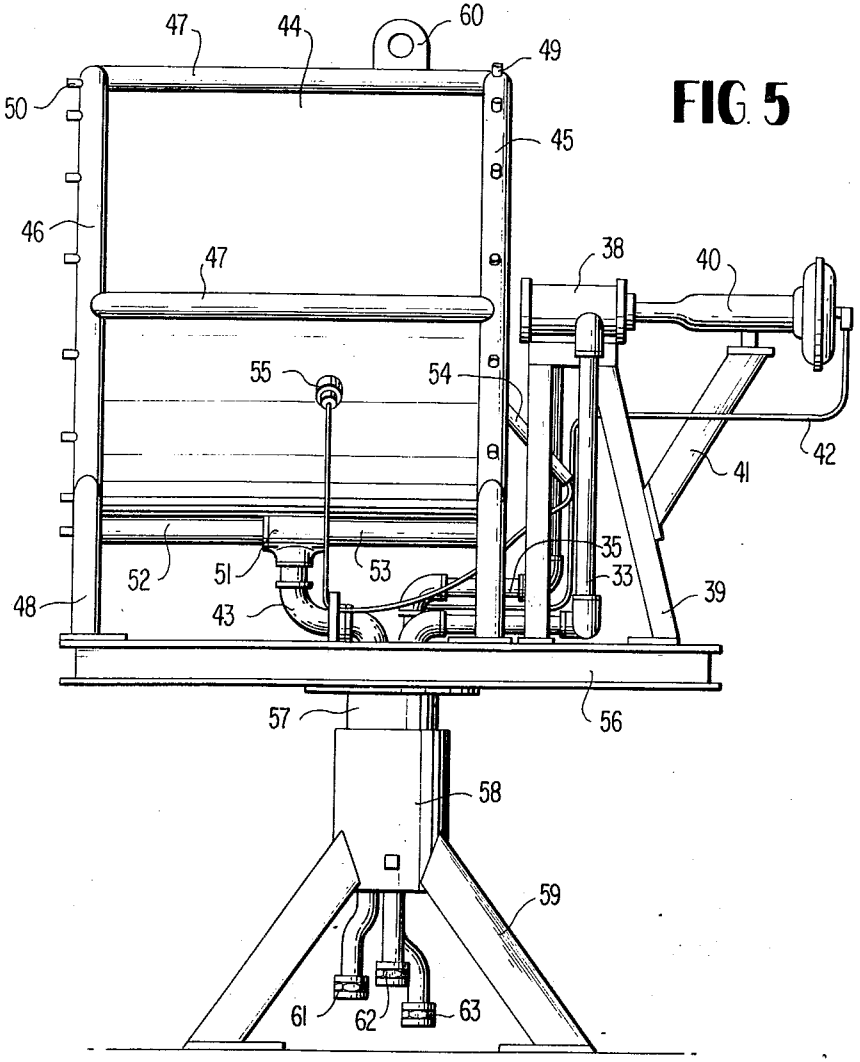
Figure 6:
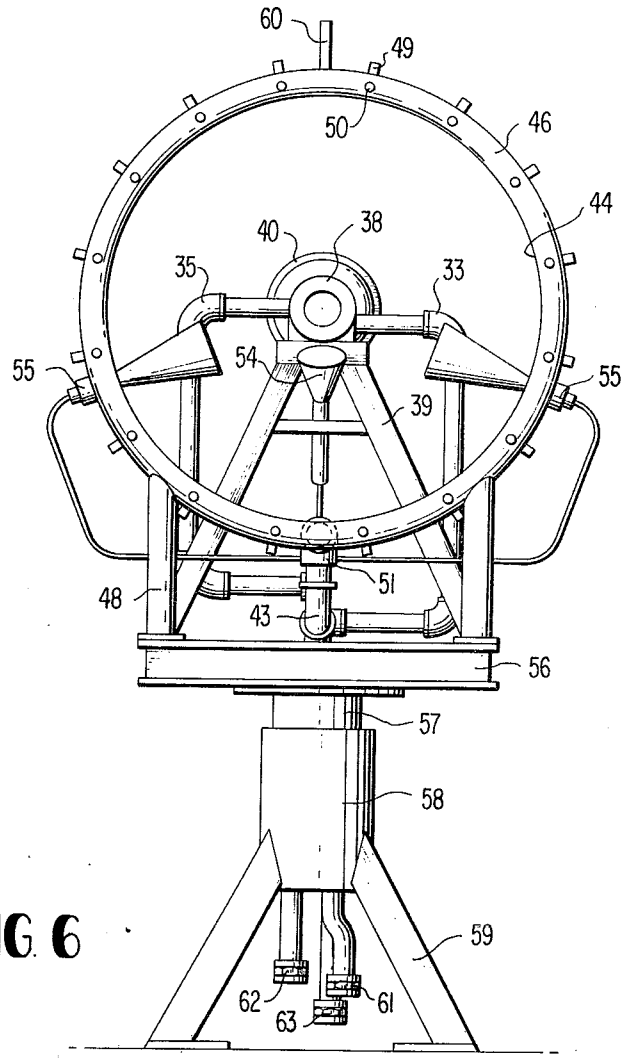

FIG. 5 shows a side view of the burner so that its principal components can be seen. FIG. 6 is a front view of the said burner.

FIGS. 5 and 6 show the sprayer 38 supported on frame 39, the product and air inlet pipes 33 and 35 respectively, the pneumatic actuator 40 supported by the beam 41 and connected to the air control line 42, the flame shield arrangement, the water inlet pipe 43, the ignition arrangement with the respective gas inlet pipe and the supporting arrangement for the apparatus.

The pneumatic actuator 40 is placed in such a position that its axis be exactly aligned with rod 10 of piston 1 of the sprayer 38, to which it is connected by means of thread 11 so as to avoid any undesirable strain on said rod which might damage it and impair the operation of the piston 1.

The flame shield arrangement comprises the cylindrical casing 44, a back ring of sprayers 45, a front ring of sprayers 46 and spacer beams 47, the whole arrangement being supported by the tubular bracket 48.

The cylindrical casing 44 is formed from bent metal sheet so as to comprise a hollow cylinder for protecting the lower part of the flame against strong winds. The cylindrical shape is given only by way of example since, for the object of the present invention, it is only necessary to form a casing shield suitable for the lower part of the flame.

The back ring of sprayers 45 comprises a ring shaped header provided with a plurality of specially designed sprayers 49 fixed in orifices distributed around said ring and directed radially outwardly so that, on passing water under pressure therethrough, a uniform water curtain is formed in a plane perpendicular to the flame axis.

The front ring of sprayers 46 is circular in the same manner as the said back ring of sprayers and is also provided with a plurality of sprayers directed in the direction of the flame and with the water outlet orifice positioned in such a manner that the jet of water under pressure is directed inwardly of the flame.

The spacer beams 47 of which there are three in the present example although this number is in no way limiting, are provided for giving stability to the flame shield arrangement, as can be seen in FIG. 5. The water inlet pipe 43 is bifurcated at the T 51 giving origin to a branch 52 which feeds the front ring of sprayers and a branch 53 feeding the back ring of sprayers 45.

The ignition arrangement comprises three basic components: the spark igniter 54 and two auxiliary pilot flame igniters 55. The above mentioned three components are fixed to the cylindrical casing 44. The particular number of components comprising the ignition arrangement as here shown is cited only by way of example and is not to be considered as a limiting factor in the present invention.

As can be seen from FIG. 6, the spark igniter 54 is positioned in front of the sprayer and directed so as to form an acute angle with the direction of the flame and in the direction in which said flame is formed. The pilot flame igniters 55 are oriented in a direction approximately perpendicular to that of the flame, facing the interior of the cylindrical casing. The gas inlet pipe to the igniters is common for the three igniters.

The support arrangement of the apparatus comprises a frame 56 formed by an arrangement of conveniently welded beams, the same frame in its turn being welded to the tubular support 57 which fits into the outer fixed tube 58 where it is suitably supported so as to permit rotation of the complete arrangement.

The external tube 58 is provided in its turn with legs formed by metal beams 59 positioned so as to give firm support to the arrangement, the legs being fixed to the support jib which is not shown in the drawings.

The inlets of the burner supply pipes 33, 35 and 43 pass into the interior of the tubular support 57, being suitably provided with rotary joints (not shown in the drawings) which permit liberty of rotation for the system.

Since the complete system due to its relatively small weight when compared with that of the previously known models, is simply removable when not in use, the upper spacer beam of the flame shield device is provided with a ring 60 for receiving the hook of a crane or winch.

The burner of the present invention, due to its tubular support system being inserted into the fixed tube 58 and also due to the fact that the water, air and oil inlet pipes are provided with screw connections 61, 62 and 63, is easily installed and removed, there merely being required for this operation sufficient time for centering and tightening the said joints.

To assist comprehension of these versed in the art, the following is a description of the working of the burner of the present invention.

All the preliminary operations to which the product is subjected before it reaches the burner itself have already been described with reference to FIG. 1 so that the present description will merely consider the operation of the burner itself, this comprising the special characteristic of the invention.

It is also unnecessary to expand upon the manner in which the auxiliary utilities are provided, such as compressed air, cooling water, purified air for instruments and the like, since these items are available in any type of installation, be it be a marine platform or a land drilling, a refinery or a terminal.

The product to be burned (independently of its origin) is admitted to the burner by means of connection 63 from which it penetrates the oil pipe 33 and enters, through orifice 34 the back chamber of the cylindrical housing (8).

The air or gas (should this exist in sufficient quantity) enters through connection 62 following pipe 35 and entering the sprayer through orifice 36 in the annular chamber 37 which has already been described.

The cooling water enters through connection 61, passing along pipe 43 until it reaches the T 51 where its flow is bifurcated to branches 52 and 53. In branch 53, the water continues to the back ring of sprayers 45 where it is expelled under pressure through sprayer 49 so as to form a uniform curtain of fine water in a plane perpendicular to the direction of the flame, this comprising the best shield against heat radiation.

In branch 52, the water continues to the front ring of sprayers 46 where it is expelled under pressure through the sprayers 50 to the interior of the flame.

The product to be burned through orifice 34, in a non-radial direction in relation to the cylindrical housing 8, so that the natural alteration of its direction of flow will produce rotation of the product current in the inner chamber 8*a* of said cylindrical housing, this contributing largely to the obtention of the desired conditions of turbulence of the product within the atomizer turbine 2.

When it leaves chamber 8*a*, the product enters the helicoidal channels 12 of the atomizer turbine 2, converging towards the center thereof already with a considerable swirling motion.

From chamber 15 within the atomizer turbine 2, the product, which is already in a state of considerable turbulence, enters the conical cavity 17 of the intermediate disc 3, reaching orifice 18 of said disc. The first stage of atomization, called mechanical atomization, is obtained in orifice 18. Another factor to be considered in the characteristics of the mechanical atomization is the volume of chamber 15 within the atomizer turbine 2, this being controlled by the movement of piston 1. The movement of said piston is obtained by the action of the pneumatic actuator 40 to which it is connected by means of rod 10. The optimum conditions of mechanical atomization are obtained by the combined control of the following factors:

A. product flow rate;

B. volume of chamber 15 with the atomizer turbine 2;

C. the swirling obtained within chamber 15 of said turbine.

These factores are adjustable to an optimum point by the operator, during burning, and will naturally depend upon the characteristics of the product to be burned.

When it leaves orifice 18 of the intermediate disc 3, the product enters the mixing chamber 24 of the centripetal stator 4 where it enters into contact with air admitted into the annular chamber 37 through orifice 36 and undergoes rotary movement due to having been forced to pass through the channels 23 formed by the raised or relief regions 22 on the centripetal stator 4 in contact with the flat face of the intermediate disc 3.

The mixture of the product with the admitted air, as mentioned above, passes through the nozzle 21 within the centripetal stator 4 and undergoes the so-called pneumatic atomization. On passing through nozzle 21, the mixture is expelled as a mist at high speed to the interior of the cylindrical casing 44 where it is ignited by the igniter arrangement formed by the spark igniter 54, and the pilot flame igniters 55, this resulting in a high intensity flame having a horizontal axis.

Having passed through the cylindrical casing 44, the flame receives the atomized water jet coming from the sprayers 50 positioned in the front ring of sprayers 46.

The said sprayers are fixed to the front sprayer ring 46 in such a way that, due to the positioning of their nozzles, the jet impinges on the flame forming an angle less than 20° with the axis of the flame.

The combination of the optimum atomization conditions with the injection of water into the flame promote the elimination of the undesirable black smoke.

Apart from this, it is known that in spite of the shielding provided by the cylindrical casing 44, there may be a necessity to alter the direction of the sprayer to maintain the flame in the prevailing wind direction so as to obtain a better combustion and avoid undesirable movement of the flame. With a view to obtaining this object, the support is designed in a special manner as shown in the earlier description so that any system to permit rotation of the complete burner by remote control can be fixed to the support tube 57.

The above mentioned rotation can be effected in such a way as to permit a movement of up to 180° about the support axis of the burner.

The burner described in the present specification has a burning capacity of product flow rates of up to 30 cubic meters per hour. For flow rates much greater than this, it is preferable to use a plurality of units as previously described in the specification, it being sufficient to divide the product flow while it is suggested to instal the said units in parallel so as to maintain the advantage of relatively low weight and facility of installation.

Another special advantage of the present invention is that when burning a product available at constant conditions of flow rate and viscosity, piston 1 can be omitted, there being used in its place an obturator in the back opening of chamber 15 of the atomizer turbine 2, and in place of the back closure 7, a blind closure may be used. In this case, it is unnecessary to use the pneumatic actuator 40 or its support and the control air supply.

The total consumption of water in the above described burner is within the range of 1.5 to 3.0 times the consumption of fuel, bearing in mind that water is provided from the same supply tube as is used for the two spray rings, having obtained not only the desired effect of eliminating black smoke but also protection against thermal back radiation with a single water pumping system which, naturally, results in economy of equipment and control.

We claim:

1. An oil burner for oil wells including a sprayer for atomizing oil products to be burned and means for igniting the atomizedd oil products at the outlet of the sprayer, comprising:

a. a housing defining a chamber, b. a turbine mounted within the housing and having a plurality of generally helical channels which communicate a first part of said chamber on one side of the turbine with a second, central part of said chamber adjacent the other side of said turbine, c. an intermediate disc member mounted within the housing adjacent said other side of said turbine, said disc member having a central orifice in communication with said central part of said chamber, d. a centripetal stator mounted within the housing and having a central outlet orifice for the atomized oil products, said outlet orifice being in communication with the central orifice in said intermediate disc and defining a mixing chamber therebetween, e. an inlet for the oil products in the housing communicating with the first part of said chamber, said inlet being non-radial with respect to the housing, f. an inlet for an atomizing gas communicating with said mixing chamber, g. an open ended flame protector casing mounted in front of the sprayer outlet such that a flame produced by combusting atomized oil products is directed along the axis of said flame protector casing, and h. a pair of rings individually mounted at each end of said flame protector casing, each ring having a plurality of water spray nozzles.

2. An oil burner according to claim 1 wherein said turbine is provided with a central bore into which said generally helical channels open, and further comprising a piston within said housing adapted for axial displacement within said central bore, an operating rod for said piston, and a back closure for said housing, said operating rod passing through said back closure.

3. An oil burner according to claim 1 wherein a first surface of said stator faces said intermediate disk and is provided with radially converging channels for communicating between said atomizing gas inlet and said mixing chamber.

4. An oil burner according to claim 1 wherein said spray nozzles at that end of said flame protector casing which is adjacent to said sprayer outlet are outwardly directed away from said sprayer.

5. An oil burner according to claim 1 wherein said spray nozzles at that end of said flame protector casing remote from said sprayer outlet are inclined inwardly in the direction of flame propagation, the axis of each of said spray nozzles forming an angle of less than 20° with the flame axis.

6. An oil burner according to claim 4 wherein said spray nozzles at that end of said flame protector casing remote from said sprayer outlet are inclined inwardly in the direction of flame propagation, the axis of each of said spray nozzles forming an angle of less than 20° with the flame axis.

7. An oil burner according to claim 1 further comprising a common feed water pipe interconnecting said spray nozzle rings and feeding said rings from the same water supply source.

8. An oil burner according to claim 1 further comprising an ignition system for igniting the atomized oil products emerging from said central outlet orifice, said ignition system comprising an electric spark igniter and pilot flame igniters.

9. An oil burner according to claim 1 wherein said burner is mounted on a support which permits its rotation through 180°.

10. An oil burner according to claim 1 wherein a water inlet, the atomizing gas inlet and the oil products inlet are provided with rotary joints at the connections with said burner.

11. An oil burner according to claim 9 further comprising a remote control device for effecting rotation of said burner on said support.

12. An oil burner according to claim 1 wherein said turbine is provided with a central bore into which said generally helical channels open, a first surface of said stator faces said intermediate disc and is provided with radially converging channels for communicating between said atomizing gas inlet and said mixing chamber, said spray nozzles at that end of said flame protector casing which is adjacent to said sprayer outlet being outwardly directed away from said sprayer, and said spray nozzles at the end of said flame protector casing remote from said sprayer outlet being inclined inwardly in the direction of flame propagation, the axis of each of said inwardly inclined spray nozzles forming an angle of less than 20° with the flame axis, and further comprising a support for said burner permitting the rotation thereof through 180°, and an electric spark igniter and pilot flame igniters positioned to ignite the atomized oil products emerging from said central outlet orifice.

* * * * *